US010644448B2

(12) United States Patent
Mickmann

(10) Patent No.: US 10,644,448 B2
(45) Date of Patent: May 5, 2020

(54) ELECTRICAL DEVICE HAVING AN EJECTOR LEVER WITH DISPLACEABLE PIVOT AXIS

(71) Applicant: WAGO Verwaltungsgesellschaft mbH, Minden (DE)

(72) Inventor: Viktor Mickmann, Wunstorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/053,381

(22) Filed: Aug. 2, 2018

(65) Prior Publication Data

US 2019/0044282 A1 Feb. 7, 2019

(30) Foreign Application Priority Data

Aug. 2, 2017 (DE) ..... 10 2017 117 509

(51) Int. Cl.
*H01R 13/633* (2006.01)
*H01R 13/635* (2006.01)
*H01H 50/04* (2006.01)

(52) U.S. Cl.
CPC ..... *H01R 13/6335* (2013.01); *H01H 50/048* (2013.01); *H01R 13/633* (2013.01); *H01R 13/635* (2013.01)

(58) Field of Classification Search
CPC . H01R 13/6335; H01R 13/633; H01H 50/048
USPC ..... 439/160
See application file for complete search history.

(56) References Cited

U.S. PATENT DOCUMENTS 4,197,572 A * 4/1980 Aimar ..... H05K 7/1409 361/755
4,241,966 A 12/1980 Gomez
5,672,072 A 9/1997 Arai et al.
5,975,930 A * 11/1999 Matsuura ..... H01R 13/62933 439/157
6,146,164 A * 11/2000 Tung ..... G06K 13/0806 439/159
8,419,475 B2 4/2013 von zur Muehlen
(Continued)

FOREIGN PATENT DOCUMENTS

DE 202007004414 U1 5/2007
DE 102012105509 A1 1/2014
(Continued)

*Primary Examiner* — Tulsidas C Patel
*Assistant Examiner* — Marcus E Harcum
(74) *Attorney, Agent, or Firm* — Muncy, Geissler, Olds & Lowe, P.C.

(57) ABSTRACT

An electrical device, having a receiving shaft for releasably receiving an electrical and/or electronic component, in particular a relay module or an electrical circuit, wherein the electrical device has an ejection device for ejecting the component, wherein the ejection device has a pivotable ejector lever. In an ejection operation, the component can be at least partially pushed from the receiving shaft by manually operating the ejector lever by a pressure force exerted on the component by the ejector lever, wherein the ejector lever is pivotably supported on the electric device without a fixed pivot axis and in an ejection operation, is configured to execute a pivoting movement of which the pivot axis is displaceable during the course of the ejection operation.

13 Claims, 3 Drawing Sheets

(56) References Cited

U.S. PATENT DOCUMENTS

| | | | | |
|---|---|---|---|---|
| 8,708,720 | B2 * | 4/2014 | Engelvin | H05K 7/1404 439/160 |
| 8,715,008 | B2 | 5/2014 | von zur Muehlen | |
| 9,060,427 | B2 | 6/2015 | Binner | |
| 9,437,973 | B2 | 9/2016 | Kamei | |
| 2013/0084724 | A1 * | 4/2013 | Yokoyama | G06K 13/0806 439/160 |
| 2015/0173223 | A1 * | 6/2015 | Binner | H01R 9/2408 174/50 |
| 2016/0055987 | A1 | 2/2016 | Brakefield | |

FOREIGN PATENT DOCUMENTS

| | | | |
|---|---|---|---|
| DE | 102014015658 | A1 | 4/2016 |
| EP | 2549516 | A1 | 1/2013 |
| EP | 2961003 | A1 | 12/2015 |

* cited by examiner

ELECTRICAL DEVICE HAVING AN EJECTOR LEVER WITH DISPLACEABLE PIVOT AXIS

This nonprovisional application claims priority under 35 U.S.C. § 119(a) to German Patent Application No. 10 2017 117 509.1, which was filed in Germany on Aug. 2, 2017 and which is herein incorporated by reference.

BACKGROUND OF THE INVENTION

Field of the Invention

The present invention relates to an electrical device with a receiving shaft for releasably receiving an electrical and/or electronic component, in particular a relay module or an electrical circuit, wherein the electrical device has an ejection device for executing an ejection operation of the component, wherein the ejection device has a pivotable ejector lever, wherein in an ejection operation upon manual actuation of the ejector lever, the component can at least partially be pushed from the receiving shaft by a pressure force exerted on the component by the ejector lever.

Description of the Background Art

A generic electrical device is known from DE 20 2007 004 414 U1, which is incorporated herein by reference.

SUMMARY OF THE INVENTION

It is therefore an object of the present invention to provide an electrical device having an ejection device, which is easy to implement and reliable in operation.

In an exemplary embodiment, the object is achieved with an electrical device in that the ejector lever is pivotally mounted on the electrical device without a fixed pivot axis and is configured to execute a pivoting movement in an ejection operation in which the pivot axis is displaceable during the course of the ejection operation. The invention has the advantage that the ejection device and in particular the ejector lever can be realized particularly simply and with few components. In particular, no fixed bearing of the ejector lever is required, as compared to the prior art. Accordingly, it is not necessary to provide bearing elements such as bearing axles or bearing pins. When pivoting the ejector lever, it can carry out a rolling-off action. This way, the electrical and/or electronic component can be easily levered out from the receiving shaft.

By means of the ejection device according to the invention, a lower actuating force can be realized which arises at the beginning of the pivoting movement from the lever arm ratio, as a result of which the dimensions of the components, in particular of the ejector lever, can be reduced and the actuation process is particularly ergonomically designed.

In an ejection operation, the ejector lever can be applied manually by a pressure force or tensile force. In particular, it is advantageous to have an actuating force with an effective direction which is oriented counter to the effective direction of the pressure force exerted on a component. This allows for a pleasant and efficient manual actuation of the ejector lever. Via the ejector lever, an actuating force acting on the ejector lever due to manual actuation of the ejector lever can be deflected to the pressure force applied to the component, wherein the effective direction of the actuating force can be oriented counter to the effective direction of the pressure force exerted on the component. In this way, the device can be pressed from the receiving shaft from below, i.e., from the side facing the bottom of the receiving shaft.

In particular, the ejector lever may be formed as an integral part of the electrical device, i.e., the ejector lever is provided by the manufacturer as part of the electrical device and is accordingly not set up to be removed from the electrical device. Thus, the ejector is not part of the electrical and/or electronic component to be ejected, such that the ejector lever has no fixing element for fixing to the electrical and/or electronic component to be ejected. The ejector lever may, e.g., be connected via a pin-slot fastening with the electrical device, in particular the housing of the electrical device. Accordingly, the ejector lever also has no fixed pivot axis relative to the electrical and/or electronic component to be ejected. As a result, the ejector lever is also displaceable relative to the electrical and/or electronic component in the course of an ejection process.

The ejector lever can have a manual actuating element, which directly manually actuates the ejector lever for pushing the component from the receiving shaft. The manual actuating element can, for example, be embodied as a recessed grip and/or have a structured surface to prevent slippage, e.g., a ribbed and/or knobbed surface. The manual actuating element may additionally have a receiving slot for an actuating tool, for example, a screwdriver.

The electrical device can have a roll-off contour for bearing the ejector lever, which is fixed with respect to the receiving shaft and on which the ejector lever can be rolled in an ejection operation so that the pivot axis is displaceable. The rolling-off action of the ejector lever is thus facilitated. The rolling-off action of the ejector lever on the roll-off contour can essentially take place without sliding, i.e., without slippage between the roll-off contour and the ejector lever. In this way, deterioration of these components is avoided. Incidental small relative displacements between the components are not critical.

The roll-off contour can be an uninterrupted (continuous) contour or a non-continuous contour. In the latter case, the roll-off contour can have gaps or can include of discrete points and/or sections, on which the bearing contour of the ejector lever rolls. Such a design of the roll-off contour can be useful, for example, if space is needed for the counter contacts within the electrical device.

The displaceable pivot axis can be formed by the bearing point of the bearing contour of the ejector lever on the roll-off contour. This bearing point is thus an instantaneous center of rotation of the ejector lever.

The ejector lever can have a linearly extending bearing contour, by which the ejector lever is supported on the roll-off contour. The ejector lever can have a bearing contour extending convexly with respect to the roll-off contour, by which the ejector lever is supported on the roll-off contour. The ejector lever can have a bearing contour extending concavely with respect to the roll-off contour, by which the ejector lever is supported on the roll-off contour, wherein the bearing contour has a greater radius of curvature than the roll-off contour.

As can be seen, various designs for shaping of the contours between the ejector lever and the roll-off contour are possible. The aforementioned possibilities can also be combined with each other, e.g., by the roll-off contour having a combination of linearly and convexly extending portions of the roll-off contour. Comparable designs are possible with respect to the bearing contour of the ejector lever. This makes it possible to tailor the contours to one another in such a way that the desired pivoting of the ejector lever, inclusive of the rolling-off action, is realized.

The electrical device can have an insulating material housing and that the roll-off contour is formed on the insulating material housing, for example, as a housing edge or a housing projection. This allows for a very cost-effective realization of the roll-off contour by integrating it into the manufacturing process of the insulating material housing.

The ejector lever can be designed as a straight lever or as a bent lever, for example as an angle lever.

The ejector lever can have a force arm and a load arm. In the case of a two-sided lever, the load arm is disposed on the side facing the electrical and/or electronic component with respect to the pivot axis of the ejector lever; the force arm may be on the side of the pivot axis facing the manual actuating element. The pivot axis also corresponds to the fulcrum of the ejector lever.

During an ejection operation, the lever ratio force arm/load arm of the ejector lever can change as a result of the geographical shift of the pivot axis, in particular, in that the lever ratio is reduced from the beginning to the end of the ejection operation. In this way, a large force can be transferred to the component to be ejected at the beginning of the ejection operation with minor change in travel. At the end of the ejection operation, when less actuating force is required for the component to be ejected, an extended actuation path is transferred, which overall leads to the component being ejected quickly with an actuating force that is comfortable for the user. At the beginning of the ejection operation, larger forces must be applied to the component since this is still held by electrical plug contacts on counter plug contacts of the electrical device. At the end of the ejection operation, this mechanical resistance is no longer present; it is merely necessary to raise the component.

In an ejection operation, the lever ratio force arm/load arm can change by at least 10%, in particular by at least 20%. The change in the lever ratio may also take on larger values, e.g., at least 40%. Again, this also further promotes the particularly ergonomic actuation of the ejection device according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
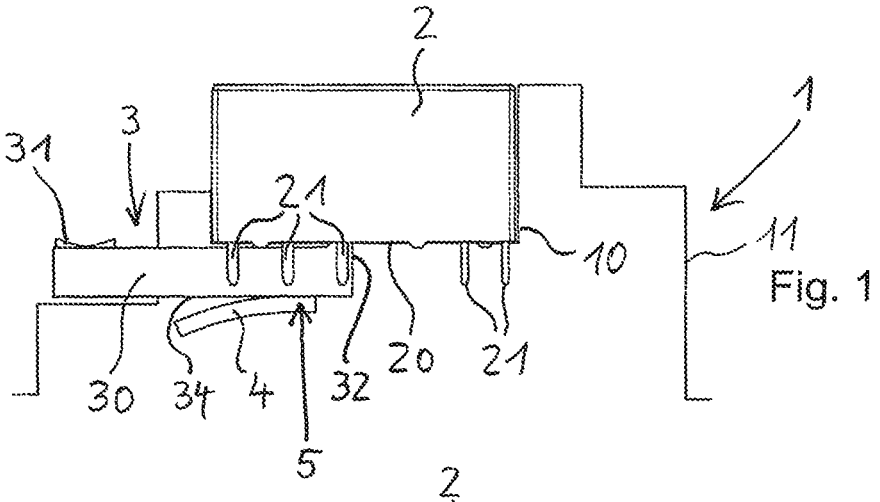
FIGS. 1 to 3 illustrate an embodiment of an electrical device.

In FIGS. 1 to 7, the electrical device is only partially shown with a view of the receiving shaft and the ejection device in a side view.

The electrical device 1 has an insulating material housing 11. In the insulating material housing 11 is a receiving shaft 10 for releasably receiving the component 2. The component 2 can be plugged into the receiving shaft 10 and be connected via its contact elements 21 with counter contact elements of the electrical device 1, for example, in the manner of a plug connection. In some cases, the component 2 is to be replaced. Since in some assembly situations, the component 2 cannot easily be grasped by hand to pull it out of the receiving shaft 10, the electrical device 1 has an ejection device for ejecting the component 2 from the receiving shaft 10.

The ejection device has an ejector lever 3 which is disposed below the component 2 with its lever arm 30 and extends up to below its underside 20, which is oriented towards the bottom of the receiving shaft 10. The ejector lever 3 is supported on a roll-off contour 4, i.e., the latter is supported downwards on this roll-off contour 4. At one end of the lever arm 30, the ejector lever 3 has the manual actuating element 31, by means of which the ejector lever 3 is actuated directly manually in order to remove the component 2 from the receiving shaft 10. At the other end, the lever arm 30 has the pressure element 32 with which a compressive force can be exerted from below against the component 2, i.e., against its bottom side 20.

Figure 2:
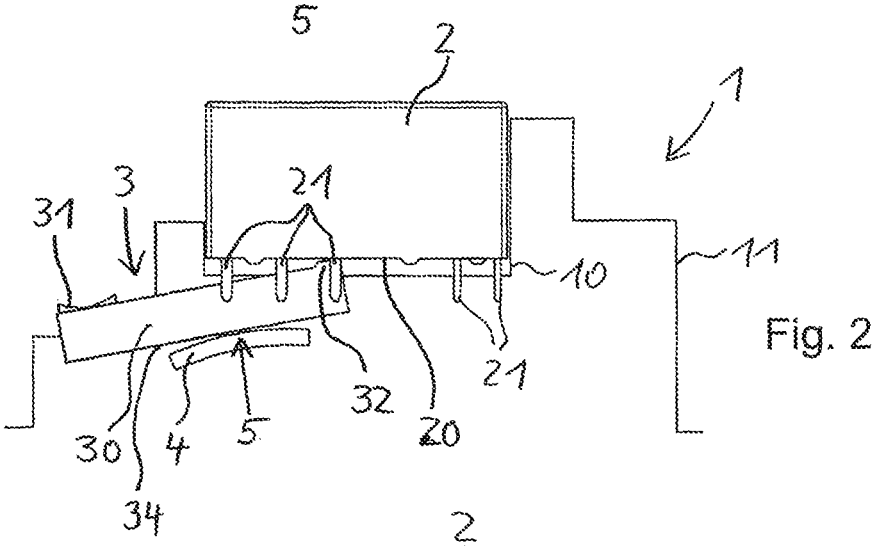
Figure 3:
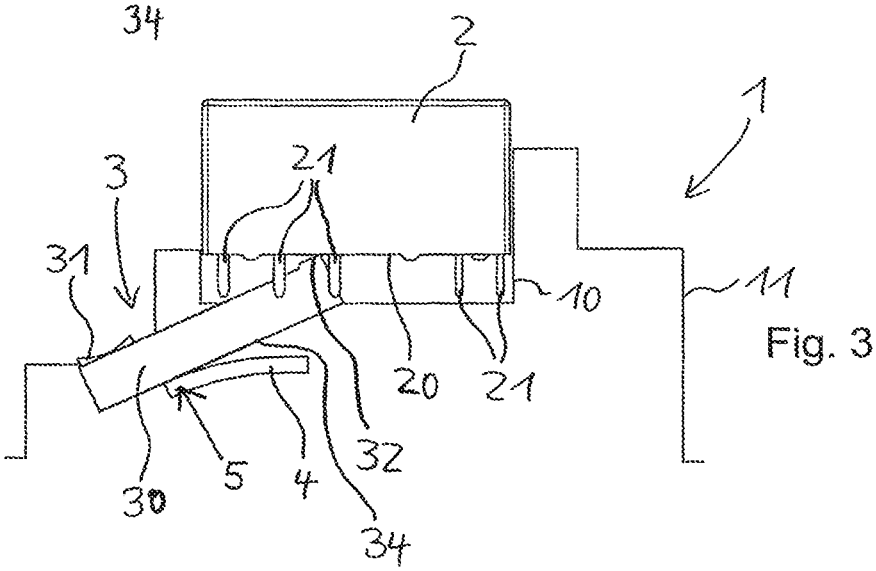

FIG. 1 shows the described elements in a state in which the ejector lever 3 is not actuated and the component 2 is completely inserted in the receiving shaft 10. FIG. 2 shows the elements in the ejection operation; FIG. 3 shows the elements at the end of the ejection operation, when the component 2 can be manually removed from the receiving shaft 10. On its side facing the roll-off contour 4, the ejector lever 3 has a bearing contour 34, wherein the bearing contour 34 is supported on the roll-off contour 4 on a bearing point 5 or rests on the roll-off contour 4. As can be seen, initially (FIG. 1), the bearing point 5 of the lever arm 30 is arranged very far to the right of the roll-off contour 4, i.e., near one end of the roll-off contour 4. The lever arm 30 is divided into a force arm, which extends from the bearing point 5 to the left in the direction of the actuating element 31 and up to the actuating element 31, and a load arm, which extends from the bearing point 5 to the right in the direction of the pressure element 32 and up to the pressure element 32. As FIG. 2 shows, with increasing pivoting of the ejector lever 3, the bearing point 5 moves to the left in the direction of the actuating element 32. The component 2 is pressed from the receiving shaft 10 via the pressure element 32 in the manner of a tappet by means of a pressure force acting from below. In FIG. 3, this operation is carried out further, where it can be seen that the bearing point 5 has now moved very far to the left, approximately to the other end of the roll-off contour 4. The bearing point 5 thereby indicates the pivot axis of the ejector lever 3.

It can further be seen that during the course of the pivoting movement of the ejector lever 3, the ratio between the length of the force arm and the length of the load arm (lever ratio force arm/load arm) is clearly reduced as a result of the displacement of the bearing point 5, e.g., at least by the factor 1.5. It can further be seen that the ejector lever 3 performs a pure rolling-off action on the roll-off contour 4, i.e., essentially no sliding movement with respect to the roll-off contour 4 occurs.

Figure 4:
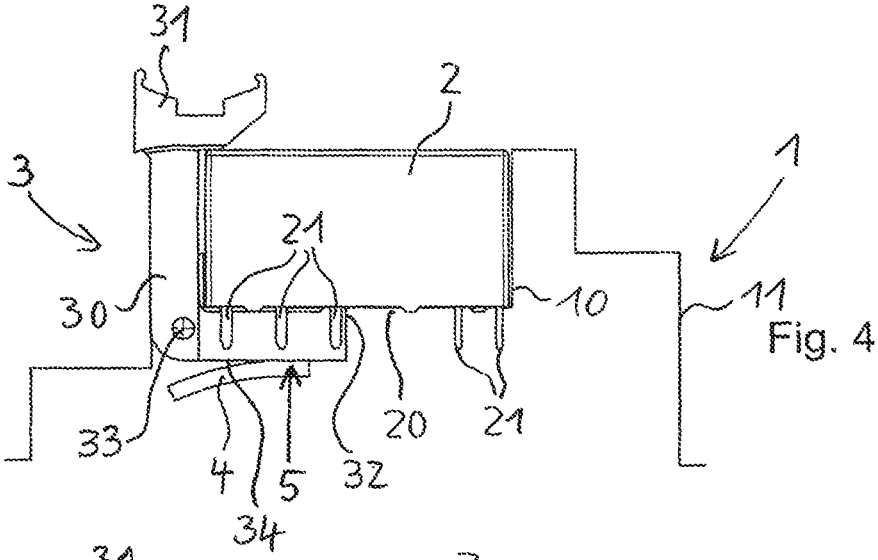
FIGS. 4 to 6 illustrate an embodiment of an electrical device.
Figure 5:
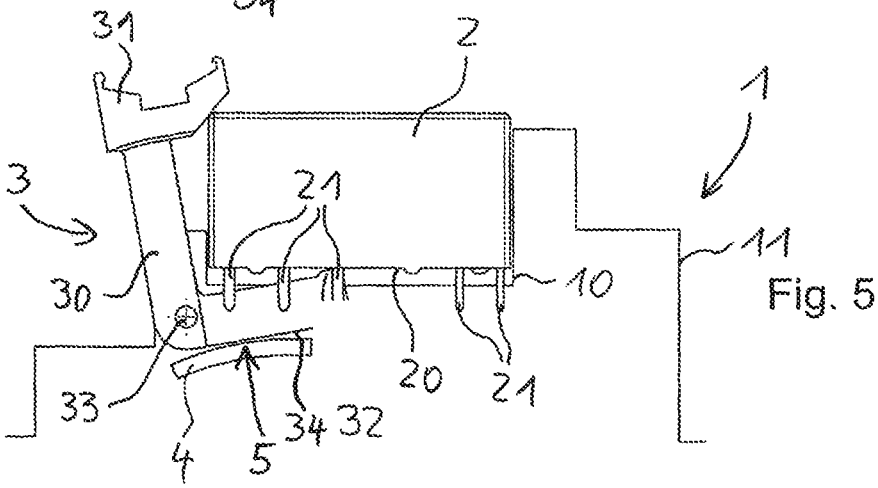
Figure 6:
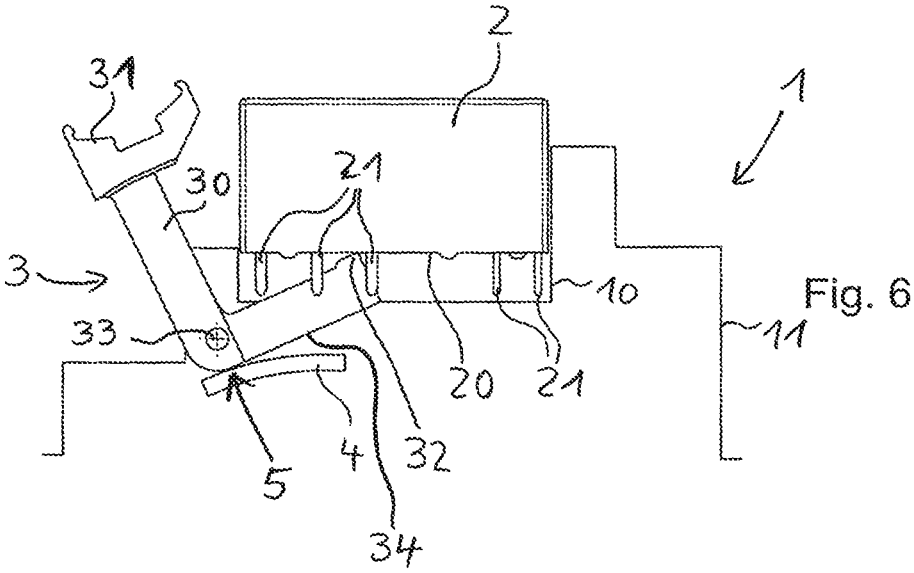

FIGS. 4 to 6 show a similar ejection operation as FIGS. 1 to 3, wherein in FIGS. 4 to 6, the ejector lever 3 is shaped differently. FIG. 4 shows the same state as FIG. 1, FIG. 5 the same state as FIG. 2, and FIG. 6 shows the same state as FIG. 3.

In FIGS. 4 to 6, the ejector lever 3 is formed as an angle lever, which accordingly has an angled lever arm 30. The lower portion of the lever arm 30 remote from the manual actuating element 31 is arranged in a similar fashion to that in FIGS. 1 to 3 and also serves to roll off on the roll-off contour 4 upon a pivoting movement of the ejector lever 3. A portion of the lever arm 30 extending at an angle thereto, which ends at the manual actuating element 31, extends to the top of the component 2. In this way, the ejector lever 3 can be actuated more comfortably from the top by means of the manual actuating element 31.

Figure 8:
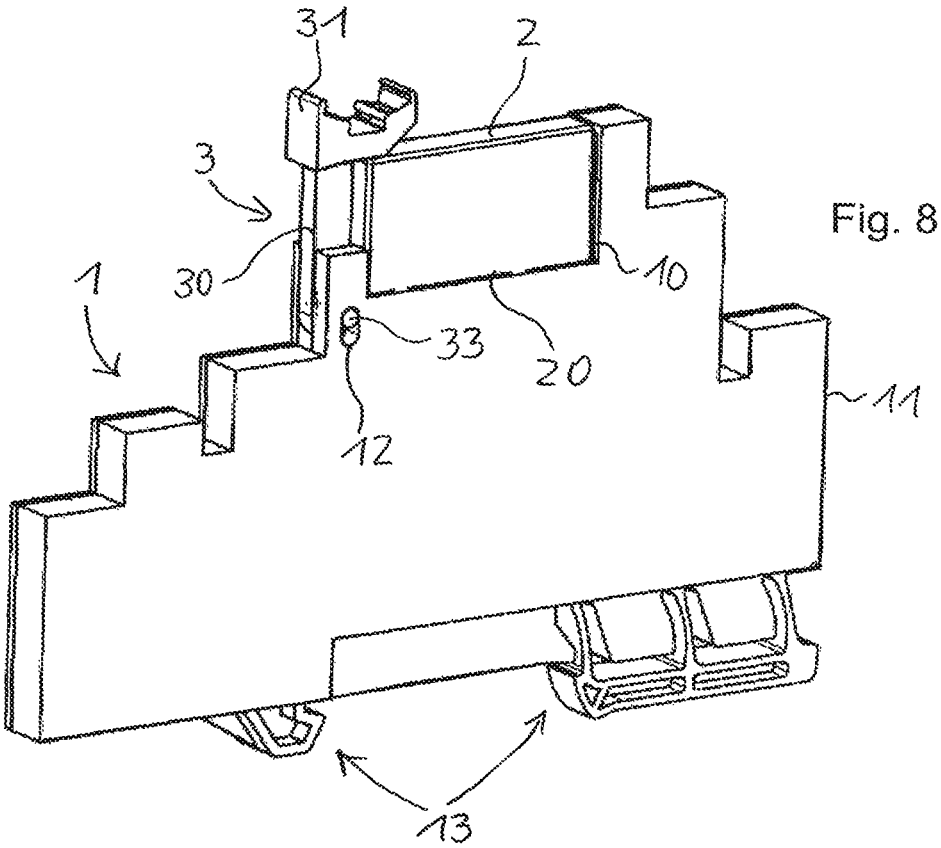
FIG. 8 illustrates an electrical device in a perspective view.

In contrast to FIGS. 1 to 3, in FIGS. 4 to 6, the ejector lever 3 is additionally guided via a holding axis 33 in an elongated hole 12 of the insulating material housing, as illustrated in particular in FIG. 8. This guidance by via the holding axis 33 allows for the ejector lever 3 to be securely fixed to the insulating material housing 11. In this case, however, the holding axis 33 does not embody the pivot axis during a pivoting movement of the ejector lever 3 in an ejection operation. The pivot axis continues to be determined by the moving bearing point 5.

Figure 7:
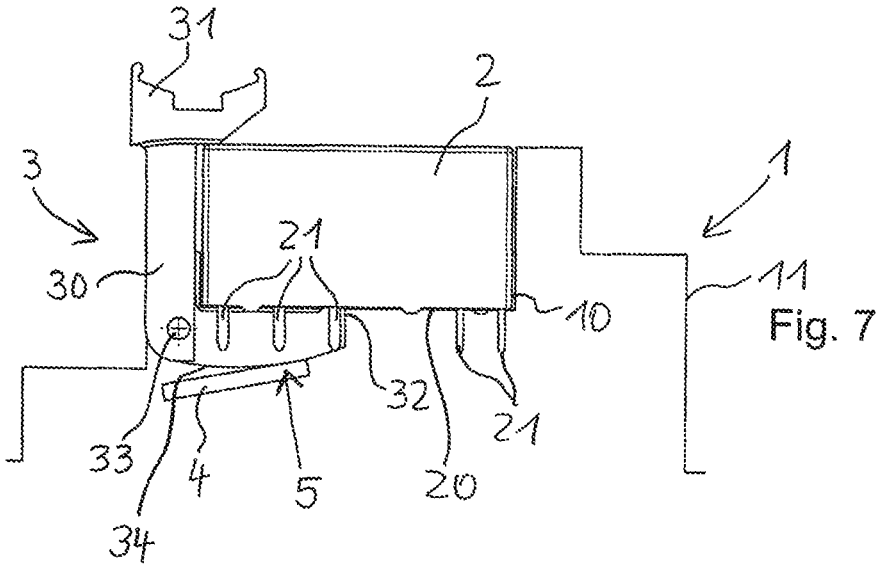
FIG. 7 illustrates an embodiment of an electrical device.

Whereas in the embodiments of FIGS. 1 to 6, the lever 30 has a linearly extending bearing contour 34 by which the ejector lever 3 is supported on the roll-off contour 4, and accordingly, the roll-off contour 4 is configured convexly with respect to the ejector lever 3, e.g., with constant curvature, FIG. 7 shows an embodiment in which a roll-off contour 4 with a linear course is realized. Accordingly, the bearing contour 34 of the ejector lever 3 has a convex course with respect to the roll-off contour 4. In both cases, the desired rolling-off action of the ejector lever 3 on the roll-off contour 4 is possible.

As shown in the figures, the lever arm 30 extends underneath the component 2 on one side of the contact elements 21, so that the pivoting movement of the lever arm 30 is not hindered by the contact elements 21. Alternatively, this portion of the lever arm 30 may also be configured in the shape of a fork so that the contact elements 21 can be disposed in a space between the forks of the lever arm.

FIG. 8 again illustrates the fixing of the ejector lever 3 via the holding axis 33 in the elongated hole 12 of the insulating housing 11. In addition, it can be seen that the electrical device 1 can be, for example, a DIN rail mounted device as is used in electrical installation technology, for example, a modular terminal. The electrical device 1 can have DIN rail fastening elements 13, e.g., on its insulating material housing 11, via which the electrical device 1 can be attached to a mounting rail of the electrical installation technology, e.g., to a DIN rail.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electrical device comprising:

a receiving shaft for releasably receiving electrical and/or electronic equipment or a relay module for an electrical circuit;

an ejection device adapted to perform an ejection operation of the component, the ejection device including a pivotable ejector lever;

wherein by manually actuating the ejector lever, the component is at least partially pressed out of the receiving shaft in the ejection operation by a pressure force exerted by the ejector lever on the component, such that the ejector lever directly contacts and pushes the component, wherein the ejector lever is pivotally mounted on the electrical device without a fixed pivot axis and is adapted to execute a pivoting movement in the ejection operation in which a displaceable pivot axis is displaced during a course of the ejection operation, wherein the electrical device has a roll-off contour, which is stationary with respect to the receiving shaft, for supporting the ejector lever on which the ejector lever is rolled during the ejection operation so that the displaceable pivot axis is displaced, and wherein a surface of the elector lever forms a bearing contour via which the ejector lever is supported on the roll-off contour, wherein the displaceable pivot axis is formed by a bearing point of the bearing contour of the ejector lever on the roll-off contour, wherein, in the ejection operation, a lever ratio of a force arm and a load arm of the ejector lever is changed by a displacement of the pivot axis such that the lever ratio is reduced from a beginning to an end of the ejection operation, and wherein the load arm is a portion of the ejector lever that extends from the bearing point to a first free end of the ejector lever that is positioned below the component and directly contacts the component and the force arm is a portion of the ejector lever that extends from the bearing point to a second free end of the ejector, the second free end opposing the first free end.

2. The electrical device according to claim 1, wherein the ejector lever is formed as part of the electrical device.

3. The electrical device according to claim 1, wherein, via the ejector lever, an actuating force acting on the ejector lever due to a manual actuation of the ejector lever is deflected towards the pressure force applied to the component, and wherein an effective direction of the actuating force is directed counter to an effective direction of the pressure force applied to the component.

4. The electrical device according to claim 1, wherein the ejector lever has a manual actuating element via which the ejector lever is to be actuated directly manually for pressing the component from the receiving shaft.

5. The electrical device according to claim 1, wherein a surface the bearing contour of the ejector lever is a linearly extending bearing contour via which the ejector lever is supported on the roll-off contour.

6. The electrical device according to claim 1, wherein the bearing contour of the ejector lever is a convex bearing contour via which the ejector lever is supported on the roll-off contour.

7. The electrical device according to claim 1, wherein the electrical device has an insulating material housing, and wherein the roll-off contour is formed on the insulating material housing.

8. The electrical device according to claim 1, wherein the lever ratio is changed from the beginning to the end of the ejection operation by at least 10%.

9. The electrical device according to claim 1, wherein ejector lever is a single, monolithic element, and wherein a position of the bearing point moves along the bearing contour of the ejector lever during the ejection operation.

10. An electrical device comprising:

a receiving shaft for releasably receiving electrical and/or electronic equipment or a relay module for an electrical circuit;

an ejection device adapted to perform an ejection operation of the component, the ejection device including a pivotable ejector lever;

wherein by manually actuating the elector lever, the component is at least partially pressed out of the receiving shaft in the ejection operation by a pressure force exerted by the ejector lever on the component, such that the ejector lever directly contacts and pushes the component, wherein the ejector lever is pivotally mounted on the electrical device without a fixed pivot axis and is adapted to execute a pivoting movement in the ejection operation in which a displaceable pivot axis is displaced during a course of the election operation, wherein the electrical device has a roll-off contour, which is stationary with respect to the receiving shaft, for supporting the ejector lever on which the ejector lever is rolled during the ejection operation so that the displaceable pivot axis is displaced wherein a surface of the ejector lever forms a linearly extending bearing contour via which the ejector lever is supported on the roll-off contour, and wherein the displaceable pivot axis is formed by a bearing point of the linearly extending bearing contour of the ejector lever on the roll-off contour.

11. The electrical device according to claim 1, wherein the ejector lever is a single, monolithic element.

12. The electrical device according to claim 1, wherein the ejector lever executes the pivoting movement in the ejection operation without use of a bearing pin.

13. An electrical device comprising:

a receiving shaft for releasably receiving electrical and/or electronic equipment or a relay module for an electrical circuit;

an ejection device adapted to perform an ejection operation of the component, the ejection device including a pivotable ejector lever;

wherein by manually actuating the ejector lever, the component is at least partially pressed out of the receiving shaft in the ejection operation by a pressure force exerted by the ejector lever on the component, such that the ejector lever directly contacts and pushes the component, wherein the ejector lever is pivotally mounted on the electrical device without a fixed pivot axis and is adapted to execute a pivoting movement in the ejection operation in which a displaceable pivot axis is displaced during a course of the ejection operation, wherein the electrical device has a roll-off contour, which is stationary with respect to the receiving shaft, for supporting the ejector lever on which the ejector lever is rolled during the ejection operation so that the displaceable pivot axis is displaced, and wherein a surface of the ejector lever forms a combination of a linearly extending bearing contour and a convex bearing contour via which the ejector lever is supported on the roll-off contour.

* * * * *